US006889964B2

(12) United States Patent
Way et al.

(10) Patent No.: US 6,889,964 B2
(45) Date of Patent: May 10, 2005

(54) DIFFUSER

(75) Inventors: Philip S. Way, Naples, NY (US); Billy Ray Bragg, Rochester, NY (US)

(73) Assignee: Filtros, Ltd., East Rochester, NY (US)

( * ) Notice: Subject to any disclaimer, the term of this patent is extended or adjusted under 35 U.S.C. 154(b) by 0 days.

(21) Appl. No.: 10/627,339

(22) Filed: Jul. 25, 2003

(65) Prior Publication Data

US 2005/0017382 A1 Jan. 27, 2005

(51) Int. Cl.[7] ..... B01F 3/04
(52) U.S. Cl. ..... 261/122.1; 261/DIG. 70
(58) Field of Search ..... 261/122.1, 124, 261/DIG. 70; 210/220, 221.1, 221.2

(56) References Cited

U.S. PATENT DOCUMENTS

| | | | | | |
|---|---|---|---|---|---|
| 2,294,973 | A | * | 9/1942 | Ford | 261/122.1 |
| 2,354,609 | A | * | 7/1944 | Phipps | 261/122.1 |
| 3,083,953 | A | | 4/1963 | Langdon et al. | |
| 3,396,950 | A | | 8/1968 | Wood | |
| 4,046,845 | A | | 9/1977 | Veeder | |
| 4,288,394 | A | | 9/1981 | Ewing et al. | |
| 4,569,805 | A | | 2/1986 | Hume et al. | |
| 4,865,778 | A | | 9/1989 | Leidel | |
| 5,075,048 | A | | 12/1991 | Veeder | |
| 5,560,874 | A | | 10/1996 | Sheckler et al. | |
| 5,858,283 | A | | 1/1999 | Burris | |
| 5,863,031 | A | | 1/1999 | Veeder et al. | |
| 6,199,836 | B1 | | 3/2001 | Rexford et al. | |
| 6,244,574 | B1 | | 6/2001 | Downs | |
| 6,322,729 | B2 | | 11/2001 | Rexford et al. | |
| 6,367,783 | B1 | | 4/2002 | Raftis | |
| 6,378,847 | B2 | | 4/2002 | Rexford et al. | |
| 6,464,211 | B1 | | 10/2002 | Downs | |
| 2002/0041041 | A1 | | 4/2002 | Johnson | |
| 2002/0070467 | A1 | | 6/2002 | Sherman | |
| 2003/0038386 | A1 | * | 2/2003 | Parayre et al. | 261/122.1 |

* cited by examiner

*Primary Examiner*—Scott Bushey
(74) *Attorney, Agent, or Firm*—Rankin, Hill, Porter & Clark LLP

(57) ABSTRACT

The present invention provides an all-ceramic diffuser assembly that includes a diffuser element formed of a porous ceramic material and a base formed of a non-permeable ceramic material. The base includes a peripheral undercut shoulder portion that overlaps a perimeter edge of the diffuser element to ceramically bond the diffuser element to the base. A conduit is formed in a fitting portion of the base for directing a stream of gas or liquid that is capable of diffusing through the diffuser element into a chamber formed between an inner surface of the diffuser element and a floor portion of the base. The present invention also provides a method of forming the diffuser assembly.

16 Claims, 3 Drawing Sheets

DIFFUSER

BACKGROUND OF THE INVENTION

1. Field of Invention

The present invention relates to a diffuser assembly for finely dispersing gases or liquids and a method of forming the same.

2. Description of Related Art

Diffuser assemblies are used in a variety of application to finely disperse gases or liquids into other liquids. Ozone gas, for example, is sometimes diffused through a diffuser assembly into water for the purpose of purifying the water. In wastewater treatment applications, wastewater is collected in a large pond, tank or basin. A manifold structure that includes a series of supply pipes arranged in an array is typically installed near the bottom of the pond, tank or basin. One or more diffuser assemblies are connected to the supply pipes at various locations to provide a substantially uniform pattern of gas dispersion throughout the lower portion of the volume of the water being treated.

The principal operative component of each diffuser assembly is a gas permeable porous diffuser element that is in communication with a chamber situated within the diffuser assembly. Gas such as ozone is supplied under pressure through the supply piping causing pressurized gas to fill the chamber. The pressure forces the gas to permeate through the interstices of the porous diffuser element into the water being treated. The gas enters the water in the form minute bubbles or microbubbles, which have a larger surface area per unit volume than bubbles of larger size. Generally speaking, the finer the bubbles that can be diffused into the water the better, because finer bubbles provide a more optimal surface area of gas exposed to the water being treated.

The diffuser element, which is sometimes referred to as a sparger in the industry, is generally formed of a gas permeable, porous material. Because of the corrosive nature of ozone, it has been found that an advantageous material for the diffuser element is a porous ceramic. This material is not vulnerable to the corrosive effects of either the sewage or of ozone gas.

One type of diffuser element made from porous ceramic material is described in U.S. Pat. No. 4,046,845, which is hereby incorporated by reference in its entirety. The diffuser assembly described in that prior art reference essentially comprises two components: (1) a relatively dense base portion that may be formed of a PVC plastic material or stainless steel; and (2) a porous ceramic diffuser element in the form of a relatively flat circular plate that seats in an annular groove or rabbet formed in the base member. The base member and the interior surface of the ceramic diffuser element define an interior chamber that is supplied with gas through an inlet tube connected to a gas supply pipe.

In this device, a seal ring formed of organic material, such as an elastomer, is positioned at the joint between the base and the outer edge of the ceramic diffuser plate. A threaded metal fastener extends through a central opening in the ceramic plate and is anchored to the base. The fastener is formed of steel and has an organic seal ring positioned between the fastener head and the upper surface of the ceramic plate.

The advantage of this construction is that the porous ceramic material provides an excellent means for diffusing minute bubbles into the liquid being treated, while at the same time, being formed of material that resists the corrosive effects of the environment including reactive gases that are being diffused. One disadvantage of this construction, however, is that the diffuser assembly includes components that are formed of materials that are vulnerable, over a period of time, to the corrosive effects of the environment it is being used in. Ozone gas is the highly corrosive, and over time the metals and/or organic plastic components in the diffuser assembly eventually fail due to corrosion damage.

U.S. Pat. No. 5,863,031, which is hereby incorporated by reference in its entirety, describes a diffuser assembly that does not include metal components, which are subject to corrosion damage. The diffuser assembly described therein comprises a housing formed of a dense ceramic material having a floor with a central inlet opening formed therein, an inlet fitting secured to the floor, and a diffuser plate formed of a porous ceramic material cemented to the top portion of a wall of the housing. This diffuser assembly, while superior to prior art diffuser assemblies, is also subject to some limitations.

Since there are no gaskets or other compressible materials used, the porous ceramic diffuser element must be cemented "hard and fast" to the top of the wall of the housing. The bond or joint formed between the diffuser element and the housing using the cement is strong, but it is also brittle. In some situations, this bond can break when the diffuser assembly is packaged, shipped, unpacked or installed. In addition, vibrations caused by the gas supply equipment can also jar the diffuser assembly enough to cause the cement joint to fail.

In addition, the inlet or fitting portion of the device described in U.S. Pat. No. 5,863,031 is typically formed of a fluorocarbon polymer. While this material is more resistant to the corrosive effects of ozone gas than some other materials, it still does not have the resistance and durability provided by inorganic ceramic materials.

BRIEF SUMMARY OF THE INVENTION

The present invention provides an all-ceramic diffuser assembly comprising a diffuser element formed of a porous ceramic material and a base formed of a non-permeable ceramic material. The base includes a peripheral undercut shoulder portion that overlaps a perimeter edge of the diffuser element to sealingly connect the diffuser element to the base. A conduit is formed in a fitting portion of the base for directing a stream of gas or liquid that is capable of diffusing through the diffuser element into a chamber formed between an inner surface of the diffuser element and a floor portion of the base.

The present invention also provides a method of forming a diffuser assembly. The method of the invention generally comprises the steps of: (i) positioning a diffuser element formed of a porous ceramic material, a decomposable separator and a removable conduit-former in a cavity of a mold that defines outer dimensions of the diffuser assembly, the diffuser element being positioned such that an outer surface thereof contacts a wall of the cavity, the separator being positioned such that it contacts an inner surface of the diffuser element, and the conduit-former being positioned such that an end portion thereof contacts the separator; (ii) injecting a slurry that is capable of being hardened and fired to form a non-porous ceramic material into the cavity such that the slurry covers the separator, surrounds at least a stem portion of the conduit-former, and forms a base having a peripheral undercut shoulder portion that overlaps a perimeter edge of the diffuser element; (iii) allowing the slurry to at least partially harden to form a green part; (iv) removing the green part from the mold and the conduit-former from the green part; and (v) firing the green part to form the non-porous ceramic material and to burn out the separator and thereby form a chamber between the inner surface of the diffuser element and a floor of the base.

The foregoing and other features of the invention are hereinafter more fully described and particularly pointed out in the claims, the following description setting forth in detail certain illustrative embodiments of the invention, these being indicative, however, of but a few of the various ways in which the principles of the present invention may be employed.

DETAILED DESCRIPTION OF THE INVENTION

Figure 1:
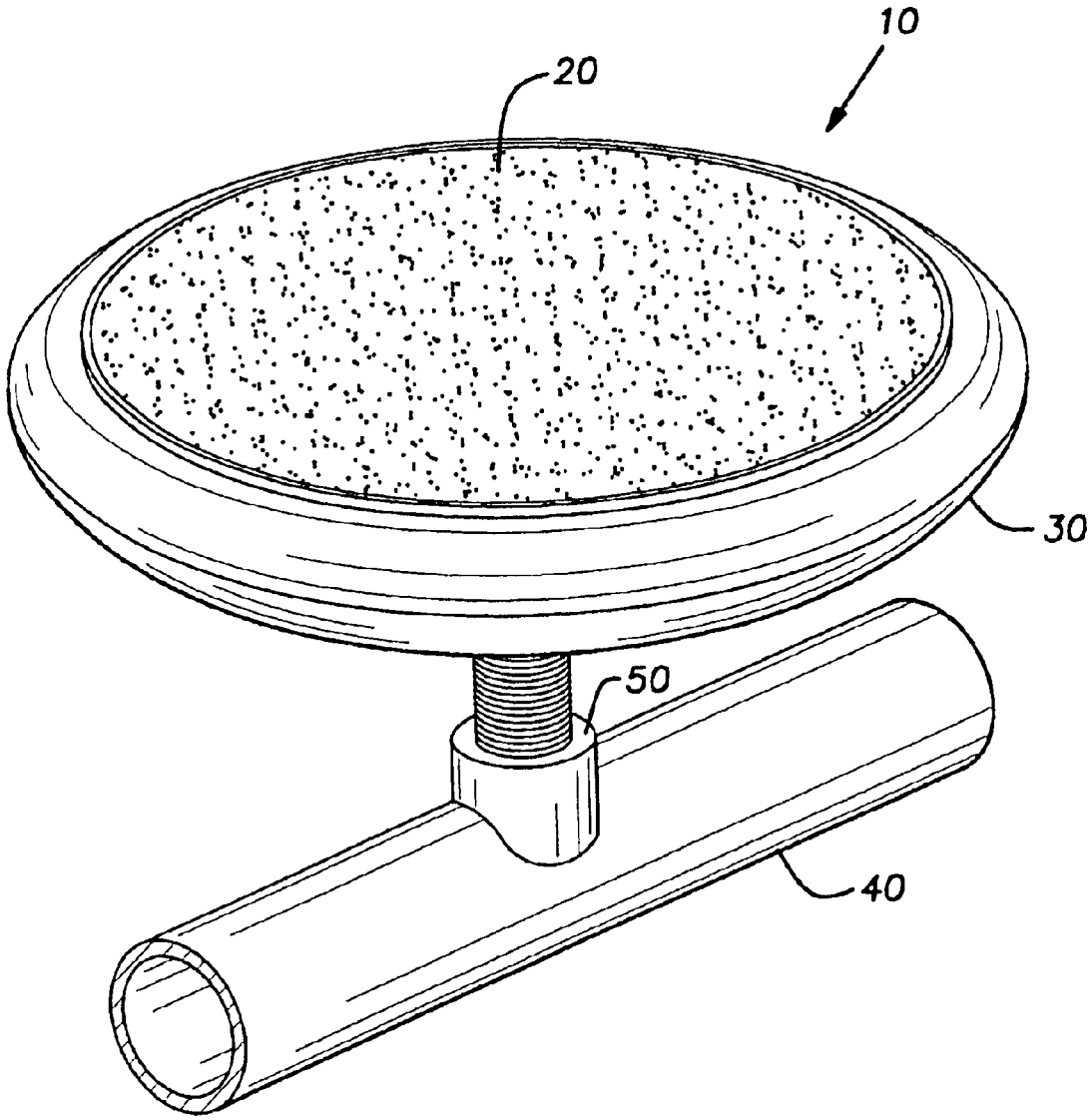
FIG. 1 is a perspective view illustrating a gas diffuser assembly according to the invention attached to a supply pipe.

Referring more particularly to FIG. 1, there is shown a perspective view of a preferred embodiment of a diffuser assembly 10 according to the invention. The diffuser assembly 10 is adapted for immersion in a liquid or semi-liquid medium. Gas or liquid pumped under pressure into a cavity within the diffuser assembly diffuses through a porous ceramic diffuser element, forming minute bubbles or microbubbles that disperse into the liquid or semi-liquid medium.

The diffuser assembly 10 is particularly adapted for use in systems where highly corrosive and/or reactive gases (e.g., ozone) or liquids need to be dispersed in liquid or semi-liquid mediums. It is well known that ozone provides an efficient reactant for purifying water in standard water treatment processes. However, the effective mixing of the ozone gas in the water is essential due to ozone's relatively low solubility in water. In such applications, the diffuser assembly 10 according to the invention can be attached to supply piping situated proximate the bottom of a water treatment receptacle such as, for example, a settling pond, tank, or basin, so as to provide a maximum time period during which the bubbles of ozone gas passing through the diffuser assembly can rise upward through the wastewater while maintaining surface contact with the wastewater so as to optimize the ensuing chemical reaction and/or treatment. As indicated above, the use of ozone gas and/or other reactive gases and liquids can present certain problems in conventional diffuser elements due to rapid corrosion of the metal components and/or organic components used therein. However, the diffuser assembly 10 of the present invention is not susceptible to these problems because it is preferably formed of all ceramic materials.

In accordance with the invention, the diffuser assembly 10 includes as its primary elements a diffuser element 20 formed of a porous ceramic material (e.g., a conventional bonded fused alumina) and a base 30 formed of a dense impermeable ceramic material (e.g., a conventional dense alumina ceramic). The diffuser assembly 10 is adapted for connection to a supply pipe 40 with a threaded fitting 50. The supply pipe 40 is adapted to supply a suitable gas or liquid to the diffuser assembly 10 under pressure.

Figure 2:
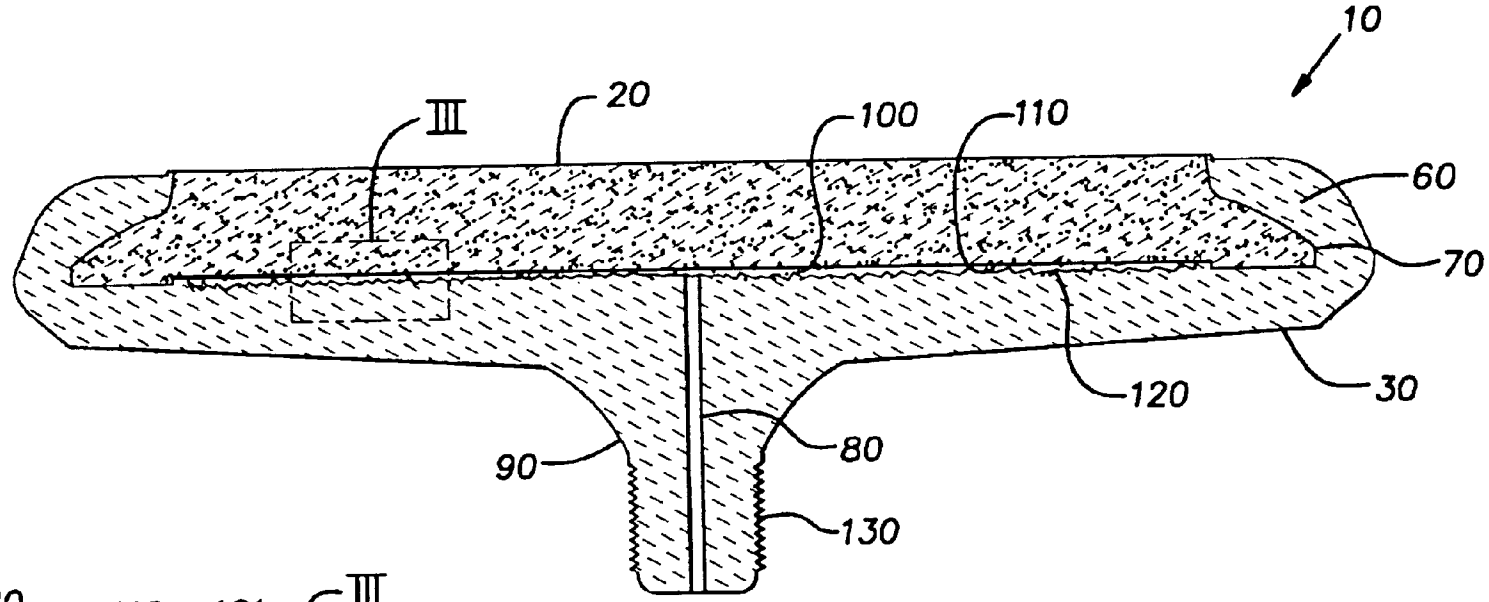
FIG. 2 is a side sectional view through the center of the diffuser assembly shown in FIG. 1.

With particular reference to FIG. 2, which shows a side sectional view through the center of the diffuser assembly 10 shown in FIG. 1, the base 30 includes a peripheral 60 undercut shoulder portion that overlaps a perimeter edge 70 of the diffuser element 20 to ceramically bond the diffuser element 20 to the base 30 without the use or need for any adhesives, cements or additional bonding agents. A conduit 80 is formed in a fitting portion 90 of the base 30 for directing a stream of gas or liquid that is capable of diffusing through the diffuser element 20 into a chamber 100 formed between an inner surface 110 of the diffuser element 20 and a floor portion 120 of the base 30. Preferably, external threads 130 formed on the fitting portion 90 for use in facilitating the attachment of the diffuser assembly 10 to a gas or liquid supply pipe 40. Thus, gas or liquid conveyed through the supply pipe 40 passes upwardly through the conduit 80 and into the chamber 100 where it is forced through interstices in the porous ceramic material and dispersed in the form of minute bubbles in the liquid or semi-liquid medium surrounding the diffuser assembly 10.

Figure 3:
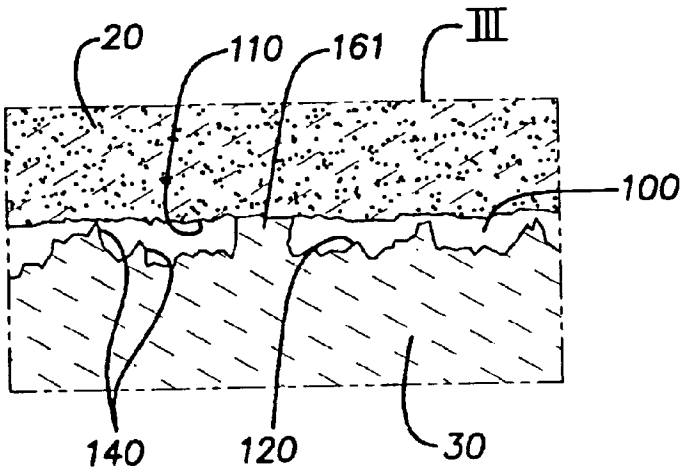
FIG. 3 is an enlarged schematic view of a portion of the sectional view shown in FIG. 2.

FIG. 3 is an enlarged view of a portion (III) of the sectional view shown in FIG. 2. FIG. 3 shows the chamber 100 formed between the inner surface 110 of the diffuser element 20 and the floor portion 120 of the base 30. The floor portion 120 of the base 30 includes a plurality of projections 140 that form a hellish or craggy surface, a portion of which preferably contact the inner surface 110 of the diffuser element 20. The projections 140 that contact the inner surface 110 of the diffuser element 20 help support the diffuser element 20 and also to maintain the spacing of the chamber 100 formed between the inner surface 110 of the diffuser element 20 and the floor portion 120 of the base 30. Such projections 140 also serve to help distribute the flow of gas or liquid within chamber 100 thereby promoting a more even distribution of gas or liquid flowing from the diffuser element 20.

As noted, the diffuser assembly according to the invention preferably does not comprise any components formed of metal or organic materials, but rather is formed of entirely of ceramic materials. Accordingly, the diffuser assembly according to the invention is significantly more resistant to corrosive damage than prior art diffuser assemblies. Thus, there is provided a diffuser assembly suitable for use in dispersing highly corrosive gases and liquids into liquid and semi-liquid mediums. Diffuser assemblies according to the invention are particularly well suited for use in dispersing ozone gas into water. However, it will be appreciated that a diffuser assembly made in accordance with the present invention may be used to disperse a variety of gases or liquids such as chlorine gas within water or chemicals, or oxygen, nitrogen or air within water or other chemicals.

It will be appreciated that the present invention contemplates that the shape of the diffuser element 20 and the base 30 may be other than a circular shape as shown in FIG. 1. For example, the diffuser element 20 and base 30 could be square or rectangular in shape. In addition, the diffuser element 20 could have a hemispherical shape, rather than a plate-like shape, with a corresponding shape for the base.

Figure 4:
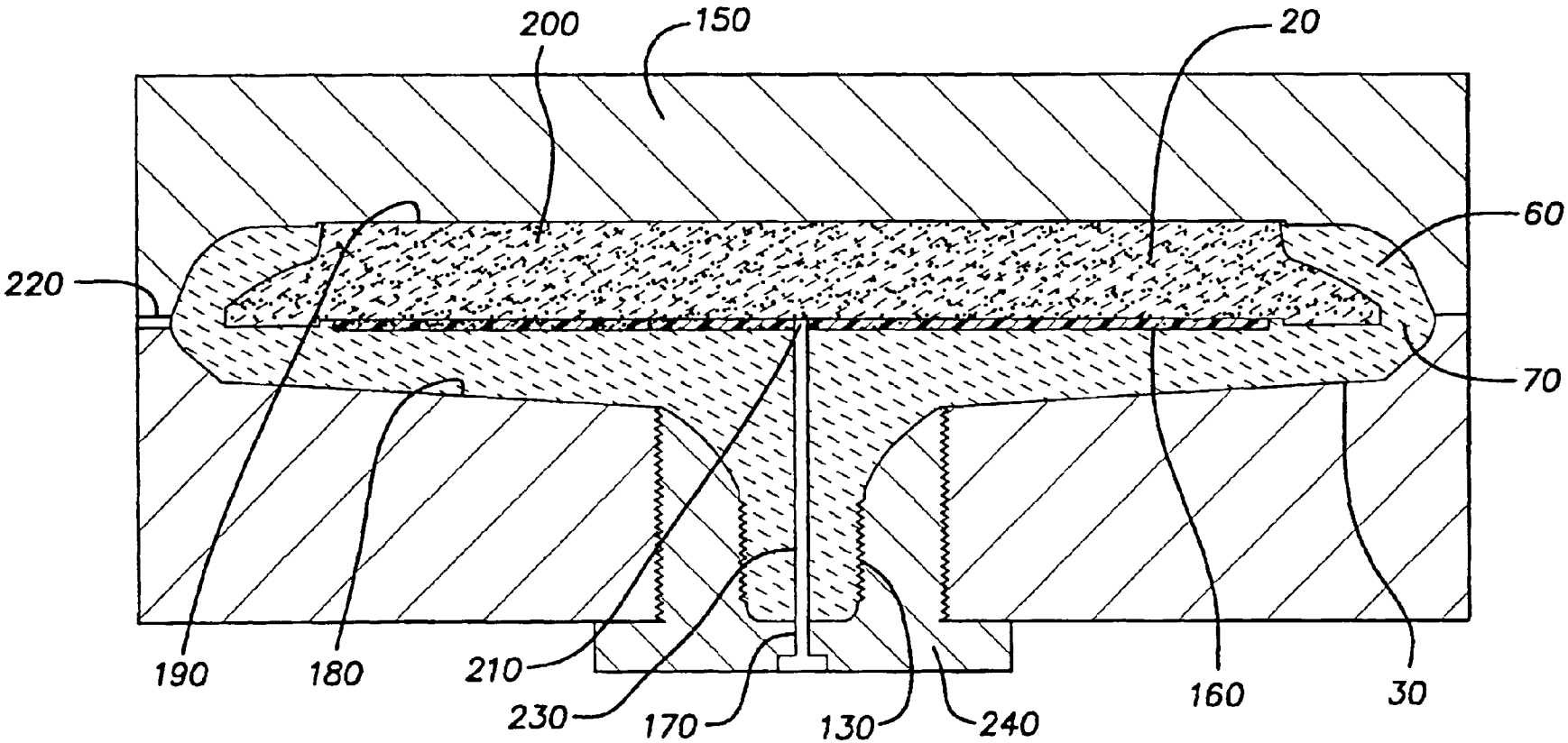
FIG. 4 is a sectional view through the center of the diffuser assembly shown in FIG. 2 as it is being formed in a mold.

The present invention also provides a method of forming a diffuser assembly. With particular reference to FIG. 4, which is a sectional view through the center of the diffuser assembly 10 shown in FIG. 2 as it is being formed in a mold 150, a diffuser element 20, a decomposable separator 160 and a removable conduit-former 170 are positioned in a cavity 180 of a mold 150 that defines outer dimensions of the diffuser assembly 10. The diffuser element 20 is positioned such that an outer surface 190 thereof contacts a wall 200 defining the cavity 180. The separator 160 is positioned such that it contacts an inner surface 110 of the diffuser element 20. And, the conduit-former 170 is positioned such that an end portion 210 thereof contacts the separator 160. A slurry that is capable of being hardened and fired to form a non-porous ceramic material is injected into the cavity 180 through a feed sprue 220 such that the slurry covers the separator 160, surrounds at least a stem portion 230 of the conduit-former 170, and forms a base 30 having a peripheral undercut shoulder portion 60 that overlaps a perimeter edge 70 of the diffuser element 20. The slurry is then allowed to at least partially harden to form a green part. The green part is then removed from the mold, and the conduit-former is removed from the green part. The green part is then fired (over 2000° F.) to form the non-porous ceramic material and to burn out the separator, which thereby forms a chamber 100 between the inner surface 110 of the diffuser element 20 and a floor portion 120 of the base 30. Preferably, the mold 150 is fitted with a removable plug 240 that forms external threads 130 on the fitting portion 90 of the base 30. During firing, a ceramic bond is formed between the shoulder portion 60 and the perimeter edge 70 of the diffuser element 20.

The separator used in the method of the present invention is not per se critical. It must be a material that is capable of being burned out at the temperatures at which the non-porous ceramic material is fired. The separator should also not decompose into residue that clogs or blocks the interstices in the diffuser element. In the presently most preferred embodiment of the invention, the separator comprises a sheet of open-celled polymeric material sold under the STYROFOAM trade designation by Floracraft, a division of Dow Chemical Company of Midland, Mich. Compression of a ½ inch thick sheet of this separator material to a thickness of ¼ inch prior to the injection of the ceramic slurry tends to result in the formation of projections 140 on the floor portion 120 of the base 30, some of which advantageously contact the inner surface 110 of the diffuser element 20. In applications where additional support of diffuser element 20 is required, separator 60 may be provided with multiple spaced ⅜" holes, such that upon injection of the ceramic slurry solid posts 161 as shown in FIG. 3 are formed between the inner surface 110 of the diffuser element 20 and the floor portion 120 of the base 30.

Diffuser assemblies according to the present invention provide many advantages over the prior art. For example, because the diffuser element and base are permanently joined together and constitute a single replacement item, there is no need for maintenance personnel to disassemble the assembly and replace either component. This eliminates the possibility of a failure of the diffuser assembly caused by human error, which has been a problem in prior art diffuser assemblies (e.g., misalignment of gaskets or application of insufficient or excessive torque to metal fasteners).

Furthermore, because the diffuser assembly according the present invention includes a peripheral undercut shoulder portion that overlaps a perimeter edge of the diffuser element to sealingly connect the diffuser element to the base, the diffuser element does not have to be perfectly flat in order to obtain a good seal. Minor imperfections and variations in the shape or contour of the diffuser element are easily overcome by the flow of ceramic slurry around the perimeter edge of the diffuser element. Furthermore, because no adhesives, cements or bonding agents are used to join the diffuser element to the base, there is significantly less likelihood that the diffuser assembly with break apart during packing, shipping, unpacking, installation and use.

The diffuser assembly according the present invention preferably does not contain any gaskets or organic materials, which are prone to eventual failure in certain environments. Thus, down time caused by failures in the diffuser assembly are minimized. Furthermore, because there are no organic seals to fail, the diffuser assemblies according to the present invention operate at peak performance for extend periods of time, resulting in energy savings.

Additional advantages and modifications will readily occur to those skilled in the art. Therefore, the invention in its broader aspects is not limited to the specific details and illustrative embodiments shown and described herein. Accordingly, various modifications may be made without departing from the spirit or scope of the general inventive concept as defined by the appended claims and their equivalents.

What is claimed is:

1. A diffuser assembly for finely dispersing a gas or a liquid flowable material comprising:

a housing formed of a dense ceramic material, said housing including a base portion having a floor and an integral fitting portion having a feed tube for transfer of said medium to said base portion, said base portion having an undercut shoulder extending along the perimeter of said base portion; and a diffuser plate formed of a porous ceramic material, said diffuser plate having upper external and lower internal surfaces and a rim portion extending along the perimeter of said plate, said shoulder portion of said base portion extending around at least a part of said rim portion of said diffuser portion so as to securely engage said rim portion, said internal surface of said diffuser plate and said floor of said base portion defining a chamber adapted to receive said flowable material under pressure through the feed tube of said fitting portion, said flowable material being capable of being diffused through said diffuser plate.

2. A diffuser assembly as set forth in claim 1 wherein said housing is formed of an injection molded ceramic material and said rim portion of said diffuser portion is ceramically bonded to said shoulder portion of said base portion.

3. A diffuser assembly as set forth in claim 1 wherein said floor of said base portion includes a bottom surface and a shelf surface disposed along the perimeter of said floor, said shelf surface supporting said diffuser plate along the outer perimeter of said diffuser plate, said bottom surface defining the bottom of said chamber.

4. A diffuser assembly as set forth in claim 3 wherein said bottom surface of said floor of said base portion comprises a craggy surface.

5. A diffuser assembly as set forth in claim 4 wherein said craggy surface partially contacts and supports the lower internal surface of said diffuser plate.

6. A diffuser assembly as set forth in claim 1 wherein said diffuser plate and said shoulder portion of said housing are circular.

7. A diffuser assembly as set forth in claim 1 wherein said fitting portion includes a base portion having external threads to facilitate the attachment of said assembly to a pipe for feeding said flowable material to said assembly.

8. A diffuser assembly comprising:

a diffuser element formed of a porous ceramic material;

a base formed of a non-permeable ceramic material, the base including a peripheral undercut shoulder portion that overlaps a perimeter edge of the diffuser element to sealingly connect the diffuser element to the base; and a conduit formed in a fitting portion of the base for directing a stream of gas or liquid that is capable of diffusing through the diffuser element into a chamber formed between an inner surface of the diffuser element and a floor portion of the base.

9. The diffuser assembly according to claim 8 wherein the diffuser element is ceramically bonded to the base without the use of any adhesives or bonding agents.

10. The diffuser assembly according to claim 8 wherein the diffuser assembly does not comprise any components formed of metal or organic materials.

11. The diffuser assembly according to claim 8 further comprising external threads formed on the fitting portion for use in facilitating the attachment of the diffuser assembly to a gas or liquid supply pipe.

12. The diffuser assembly according to claim 8 wherein the floor portion of the base includes a plurality of projections.

13. The diffuser assembly according to claim 12 wherein at least one of the projections contacts the inner surface of the diffuser element.

14. The diffuser assembly according to claim 8 wherein the diffuser element comprises a plate having a circular shape.

15. The diffuser assembly according to claim 8 wherein the base is formed of an injection-molded non-porous ceramic material.

16. The diffuser assembly according to claim 8 used to diffuse ozone gas into water.

* * * * *